US010212774B2

(12) United States Patent
In et al.

(10) Patent No.: US 10,212,774 B2
(45) Date of Patent: Feb. 19, 2019

(54) LAMP DRIVING CIRCUIT

(71) Applicant: ROHM CO., LTD., Ukyo-ku, Kyoto (JP)

(72) Inventors: Jung-Nam In, Gyeonggi-do (KR); Jong-Won Kim, Gyeonggi-do (KR)

(73) Assignee: ROHM CO., LTD., Kyoto (JP)

( * ) Notice: Subject to any disclaimer, the term of this patent is extended or adjusted under 35 U.S.C. 154(b) by 0 days.

(21) Appl. No.: 15/673,889

(22) Filed: Aug. 10, 2017

(65) Prior Publication Data

US 2018/0049290 A1 Feb. 15, 2018

(30) Foreign Application Priority Data

Aug. 11, 2016 (KR) ..... 10-2016-0102480

(51) Int. Cl.
*H05B 33/08* (2006.01)

(52) U.S. Cl.
CPC ..... *H05B 33/0851* (2013.01); *H05B 33/0815* (2013.01)

(58) Field of Classification Search
CPC ..... G09G 2310/06; G09G 2320/0247; G09G 2320/0252; G09G 2320/064; G09G 2320/0693; G09G 3/342; G09G 3/36; G09G 2330/021; H05B 33/0815; H05B 33/0818; H05B 33/0827; H05B 33/083; H05B 33/0845; H05B 33/0851; H05B 33/0887; Y02B 20/341; Y02B 20/347
See application file for complete search history.

(56) References Cited

U.S. PATENT DOCUMENTS

2011/0157246 A1* 6/2011 Jang ..... G09G 3/3406 345/690
2014/0028205 A1* 1/2014 Lischka ..... H05B 33/0818 315/193
2014/0070728 A1* 3/2014 Pflaum ..... H02M 3/156 315/307
2014/0346953 A1* 11/2014 Hsiung ..... H05B 33/0815 315/121
2017/0332453 A1* 11/2017 Yoon ..... H05B 33/0851

* cited by examiner

*Primary Examiner* — Alexander H Taningco
*Assistant Examiner* — Renan Luque
(74) *Attorney, Agent, or Firm* — Cantor Colburn LLP

(57) ABSTRACT

A lamp driving circuit for driving a lamp part, includes a correction part configured to receive a first control signal for driving the lamp part with a predetermined brightness, to receive duty information indicative of a ratio of a supply voltage for operating the lamp part and a voltage across the lamp part, and to correct the first control signal based on the duty information to generate a second control signal, and a control part configured to receive the second control signal from the correction part, and to drive the lamp part with the predetermined brightness based on the second control signal.

7 Claims, 8 Drawing Sheets

FIG. 8A

| External control signal | Target brightness | Required $I_L$_Max | Duty 50% | | Duty 23% | |
|---|---|---|---|---|---|---|
| | | | Actual IL_Max | Brightness error | Actual IL_Max | Brightness error |
| 1.5 V | 100 % | 2000 mA | 1953 mA | -2.53 % | 2047 mA | 2.35 % |
| 1.05 V | 70 % | 1400 mA | 1311 mA | -6.38 % | 1395 mA | -0.38 % |
| 0.675 V | 45 % | 900 mA | 816 mA | -9.31 % | 886 mA | -1.51 % |

FIG. 8B

| External control signal | Target brightness | Required $I_L$_Max | Duty 50% | | | Duty 23% | | |
|---|---|---|---|---|---|---|---|---|
| | | | Internal control signal | Actual IL_Max | Brightness error | Internal control signal | Actual IL_Max | Brightness error |
| 1.5 V | 100 % | 2000 mA | 1.514 V | 2018 mA | 0.92 % | 1.492 V | 1989 mA | -0.55 % |
| 1.05 V | 70 % | 1400 mA | 1.046 V | 1395 mA | -0.34 % | 1.038 V | 1384 mA | -1.12 % |
| 0.675 V | 45 % | 900 mA | 0.662 V | 882 mA | -1.96 % | 0.672 V | 896 mA | -0.42 % |

LAMP DRIVING CIRCUIT

CROSS-REFERENCE TO RELATED APPLICATION

This application is based upon and claims the benefit of priority from Korean Patent Application No. 10-2016-102480, filed on Aug. 11, 2016, the entire contents of which are incorporated herein by reference.

TECHNICAL FIELD

The present disclosure relates to a lamp driving circuit, and more particularly, to an LED lamp driving circuit capable of minimizing a control error in the brightness of an LED lamp.

BACKGROUND

A light emitting diode (LED) is an eco-friendly light source that has advantages such as small size, light weight, low voltage drive, long lifespan and the like. Owing to such advantages, an LED is attracting attention as a next-generation light source to replace fluorescent lamps. According to this trend, cold cathode fluorescent lamp (CCFL) backlights (fluorescent lamps) used in display devices such as television, monitors and the like have been replaced by LED backlights.

When using an LED as a backlight, the brightness of the LED should be controlled with high accuracy. However, in existing LED lamp driving circuits, the brightness of the LED was not accurately maintained at the required brightness thereby causing errors.

SUMMARY

Some embodiments of the present disclosure provide an LED driving circuit capable of correcting errors in the brightness of an LED due to various delays within a control circuit and/or a change in duty ratio.

According to one embodiment of the present disclosure, a lamp driving circuit for driving a lamp part includes: a correction part configured to receive a first control signal for driving the lamp part with a predetermined brightness, to receive duty information indicative of a ratio of a supply voltage for operating the lamp part and a voltage across the lamp part, and to correct the first control signal based on the duty information to generate a second control signal, and a control part configured to receive the second control signal from the correction part, and to drive the lamp part with the predetermined brightness based on the second control signal.

BRIEF DESCRIPTION OF THE DRAWINGS

FIGS. 8A and 8B are diagrams illustrating results of testing a control error in the brightness of a lamp part of the lamp driving circuit using the circuit diagram of FIG. 6.

DETAILED DESCRIPTION

Embodiments of present disclosure will be now described in detail with reference to FIGS. 1 to 8B.

Figure 1:
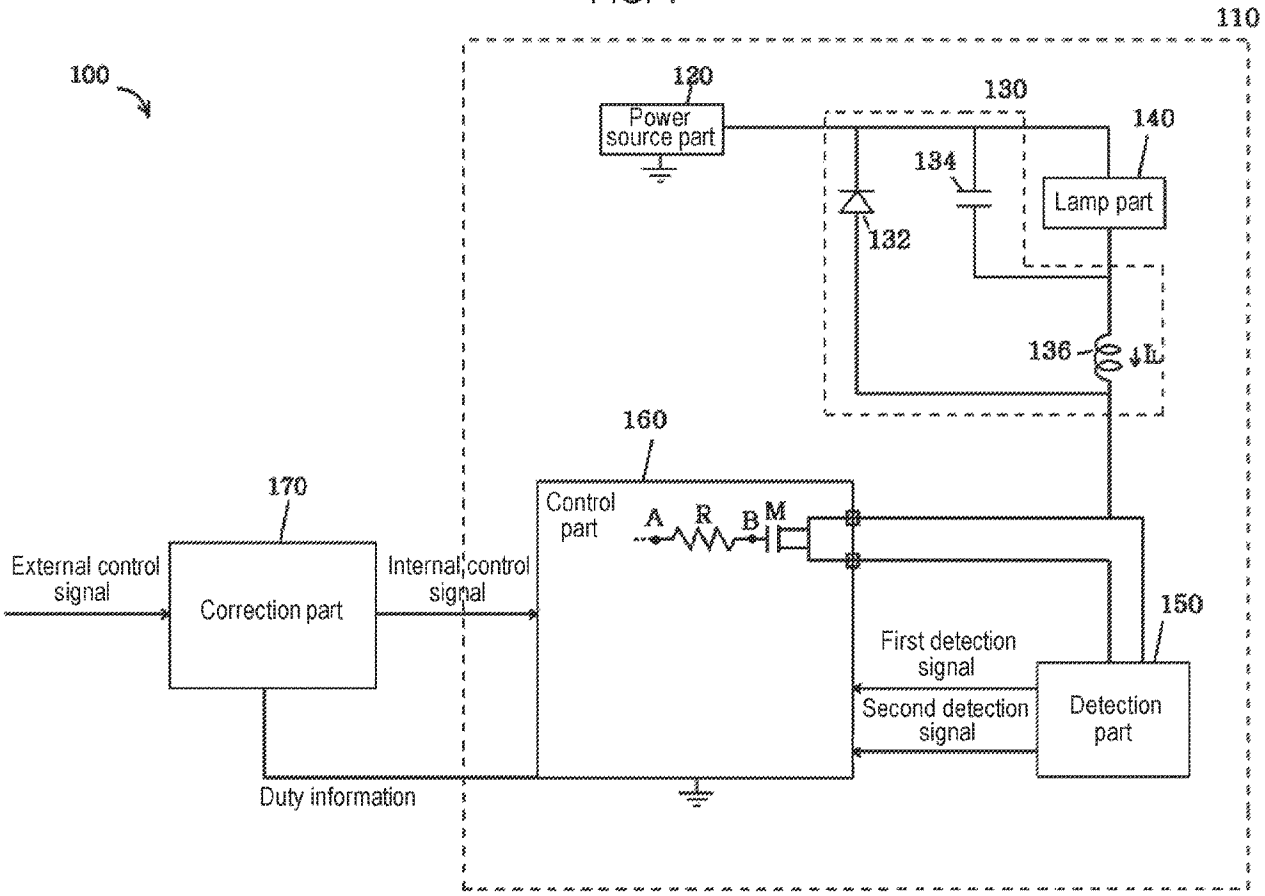
FIG. 1 is a circuit diagram of a lamp driving circuit according to one embodiment of the present disclosure.

FIG. 1 is a circuit diagram of a lamp driving circuit 100 according to one embodiment of the present disclosure. The lamp driving circuit 100 may include a lamp brightness control circuit 110 and a correction part 170. The lamp brightness control circuit 110 may include a power source part 120, an energy transmission part 130, a lamp part 140, a detection part 150, and a control part 160. The power source part 120 may be connected to the energy transmission part 130 to provide energy for driving the lamp part 140. In one embodiment, the lamp brightness control circuit 110 may include a quasi-resonant (QR) buck converter, and the power source part 120 may be a voltage source that can provide a supply voltage to operate the lamp part 140.

The correction part 170 may receive an external control signal for driving the lamp part 140 with a predetermined brightness. For example, when the lamp part 140 is required to be driven with a brightness of 100%, an external control signal of 1.0 V may be provided. Further, when the lamp part 140 is required to be driven with a brightness of 50%, an external control signal of 0.5 V may be provided. The correction part 170 may correct the external control signal to an internal control signal in order to correct various lamp brightness errors which may occur in the lamp brightness control circuit 110.

In one embodiment, the correction part 170 may be configured to generate an internal control signal by correcting the external control signal in order to correct an error in brightness of the lamp part 140 which occurs due to a change in a ratio of a voltage of the power source part 120 (a supply voltage for operating the lamp part 140) and a voltage across the lamp part 140 and/or correct an error in brightness of the lamp part 140 which occurs due to various detection/control delays within the control part 160. In this case, the correction part 170 may correct the external control signal to the internal control signal based on information indicative of input/output characteristics of the lamp brightness control circuit 110 and/or duty information indicating a ratio (hereinafter, referred to as a "duty ratio") of the voltage of the power source part 120 and the voltage across the lamp part 140 received from the control part 160. In one embodiment, the information indicative of the input/output characteristics of the lamp brightness control circuit 110 may be information indicative of the internal control signal input to the control part 160 and brightness of the lamp part 140 corresponding to the internal control signal as an output. The duty ratio may be changed depending on a change in voltage of the power source part 120, manufacturing variations of LEDs within the lamp part 140, a change in temperature, or the like. In one embodiment, the control part 160 may directly detect the voltage of the power source part 120 and the voltage across the lamp part 140 and provide duty information to the correction part 170. A duty ratio of a high level signal and a low level signal for controlling ON/OFF of a transistor M is substantially the same as the ratio of the voltage of the power source part 120 and the voltage across the lamp part 140. Thus, in another embodiment, the control part 160 may provide the ratio of the high level signal and the low level signal for controlling ON/OFF of the transistor M, as the duty information, to the correction part 170.

The control part. 160 may drive the lamp part 140 with predetermined brightness based on the internal control signal provided from the correction part 170. The lamp part 140 may include a plurality of LEDs and may be driven by energy transmitted from the power source part 120 through the energy transmission part 130. In one embodiment, the energy transmission part 130 may include a diode 132, a capacitor 134, and an inductor 136. In this case, the power source part 120 is connected to one end of the diode 132, and the detection part 150 and the control part 160 may be connected to the other end of the power source part 120. The capacitor 134 and the inductor 136 connected in series may be connected in parallel to the diode 132, and the lamp part 140 may be connected in parallel to the capacitor 134.

The control part 160 may control the energy transmitted from the power source part 120 to the lamp part 140 through the energy transmission part 130 based on the internal control signal. The brightness of the lamp part 140 may be determined by an average value of a current flowing through the lamp part 140, and in one embodiment, the control part 160 may control the current flowing through the lamp part 140 to be increased or decreased to drive the lamp part 140 with predetermined brightness. Specifically, the control part 160 may set a target value of a current which will flow through the lamp part 140 based on the internal control signal. When the current flowing through the lamp part 140 reaches the target value, the control part 160 may control the current flowing through the lamp part 140 to be decreased. Further, when the current flowing through the lamp part 140 becomes 0 A, the control part 160 may control the current flowing through the lamp part 140 to be increased.

Since a current $I_L$ flowing through the inductor 136 is substantially the same as a current flowing through the lamp part 140, the detection part 150 may monitor the current flowing through the lamp part 140 by monitoring the current $I_L$ flowing through the inductor 136. When the current $I_L$ flowing through the inductor 136 reaches the target value, the detection part 150 may provide a first detection signal to the control part 160. Further, when the current $I_L$ flowing through the inductor 136 becomes 0 A, the detection part 150 may provide a second detection signal to the control part 160.

In one embodiment, the control a 160 may include the transistor M and may operate in a quasi-resonant (QR) mode. Specifically, when the first detection signal is received from the detection part 150, the control part 160 may turn off the transistor M to decrease the current flowing through the lamp part 140. Further, when the second detection signal is received, the control part 160 may turn on the transistor M to increase the current flowing through the lamp part 140. In another embodiment, the transistor M may be positioned outside the control part 160. A predetermined delay may occur from a timing when the control part 160 receives the first detection signal from the detection part 150 to a timing when the control part 160 turns off the transistor M, which may cause an error in the brightness of the lamp part 140. In order to correct the error in brightness of the lamp part 140 due to detection/control delays within the control part 160 described above, the correction part 170 may be configured to correct the external control signal to the internal control signal based on the information indicative of the input/output characteristics of the lamp brightness control circuit 110. Furthermore, in order to correct the error in brightness of the lamp part 140 which occurs due to the change in ratio of the voltage of the power source part and the voltage across the lamp part, the correction part 170 may be configured to further correct the external control signal to the internal control signal based on the duty information received from e control part 160.

Figure 2:
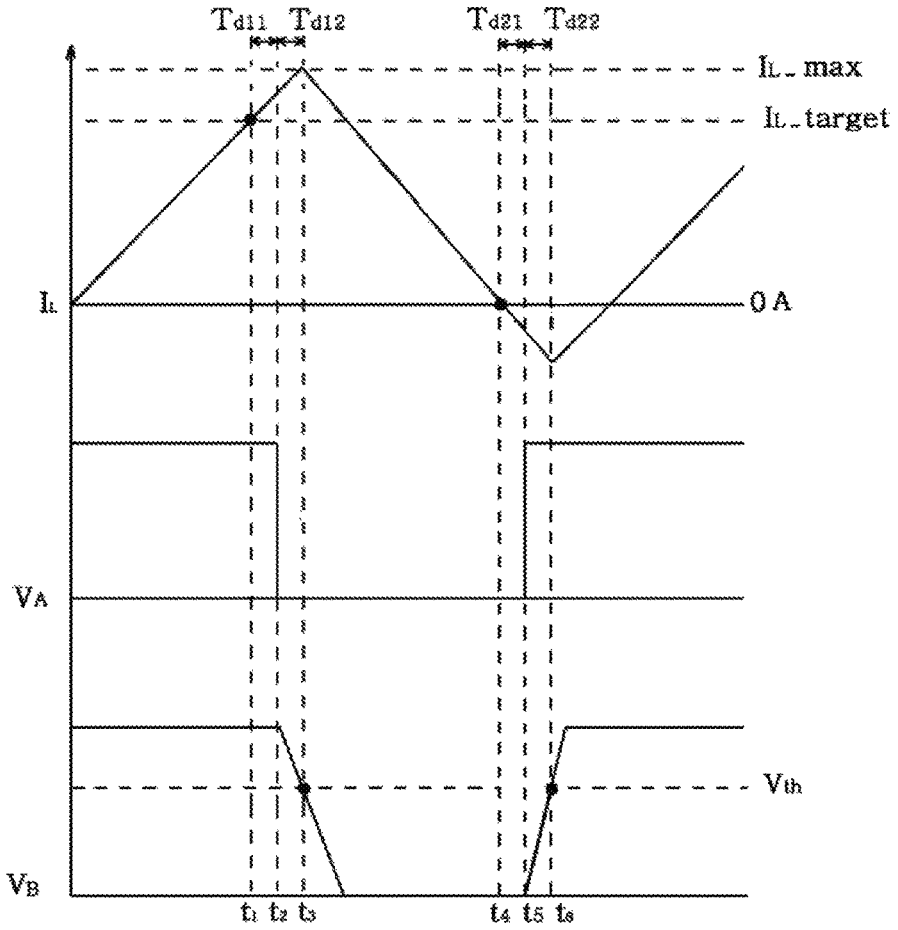
FIG. 2 is a graph illustrating operational waveforms of the lamp driving circuit.

FIG. 2 is a graph illustrating operational waveforms of the lamp driving circuit 100. $I_L$ denotes a current (which is substantially the same as the current flowing through the lamp part 140) flowing through the inductor 136 of the energy transmission part 130. The brightness of the lamp part 140 is determined by an area of $I_L$ on the graph. $V_A$ denotes an internal signal output to control the transistor M by the control part 160 based on the first and second detection signals received from the detection part 150. Further, $V_A$ may include a high level signal for turning on the transistor M and a low level signal for turning off the transistor M. As described above, since a ratio of the high level signal and the low level signal of $V_A$ is substantially the same as the ratio of the voltage of the power source part and the voltage across the lamp part, the control part 160 may provide the ratio of the high level signal and the low level signal of $V_A$, as the duty information, to the correction part 170.

As can be seen from FIG. 1, $V_A$ is applied to a gate of the transistor M through a resistor R. $V_B$ denotes a gate voltage of the transistor M. When $V_B$ is equal to or greater than a threshold value $V_{th}$, the transistor M is turned on to increase $I_L$. Further, when $V_B$ is lower than the threshold value $V_{th}$, the transistor M is turned off to decrease $I_L$.

As described above, the correction part 170 may correct the external control signal to the internal control signal in order to correct various lamp brightness errors which may occur in the control part 160. For example, the external control signal may be 1.0 V indicating that the lamp part 140 is driven with a brightness of 100%. The correction part 170 may correct the external control signal 1.0 V based on the internal control signal input to the control part 160, the information indicative of the brightness of the lamp part corresponding to the internal control signal and/or the duty ratio, to thereby output the internal control signal 0.95V.

The control part 160 may set a target value $I_{L_}$target of $I_L$ based on the internal control signal. When $I_L$ reaches $I_{L_}$target, the control part 160 turns off the transistor M to decrease $I_L$. Further, when $I_L$ becomes 0 A, the control part 160 may turn on the transistor M to increase $I_L$. As shown in FIG. 2, since the transistor M is turned on until $t_1$, $I_L$ increases. The detection part 150 may detect that $I_L$ has reached the target value $I_{L_}$target at $t_1$, and provide the first detection signal to the control part 160. Although the control part 160 receives the first detection signal at $t_1$, due to an internal delay, $V_A$ is changed to a low level signal for turning off the transistor M at $t_2$. That is, a time delay $T_{d11}$ may occur from the timing $t_1$ when the control part 160 receives the first detection signal to the timing $t_2$ when $V_A$ is changed to a low level signal.

When $V_A$ is changed to a low level signal, the gate voltage $V_B$ of the transistor M starts to decrease. Since $V_B$ should be decreased to $V_{th}$ to turn off the transistor M, $V_A$ is changed to a low level signal and a time delay may occur for the transistor M to be turned off. As can be seen from FIG. 2, $V_A$ is changed to a low level signal, but $V_B$ is lower than $V_{th}$ at $t_3$ and thus the transistor M is turned off at $t_3$. That is, a time delay $T_{d12}$ may occur from the timing $t_2$ when $V_A$ is changed to a low level signal to the timing $t_3$ when the transistor M is turned off within the control part 160. As a result, a time delay $T_{d11}+T_{d12}(=T_{d1})$ occurs from the timing $t_1$ when $I_L$ has reached $I_L$_target to the timing $t_3$ when the transistor M is turned off and $I_L$ starts to decrease. As a result, $I_L$ exceeds $I_L$_target and increases up to $I_L$_max. That is, the correction part 170 may correct the external control signal in consideration of an error that the brightness of the lamp part 140 is greater than the target value due to a state in which $I_L$ exceeds $I_L$_target and increases up to $I_L$_max.

As described above with reference to FIG. 1, the correction part 170 may be configured to correct the external control signal to the internal control signal in order to correct the error in brightness of the lamp part 140 which occurs due to various delays within the control part 160. The delay within the control part 160 may be the time delay $T_{d11}+T_{d12}$ ($=T_{d1}$) from the timing $t_1$ when $I_L$ has reached $I_L$_target to the timing $t_3$ when the transistor M is turned off and $I_L$ starts to decrease. In order to correct the error in the brightness due to the delay $T_{d11}+T_{d12}(=T_{d1})$ within the control part 160, the correction part 170 may be set in advance based on the information indicative of the internal control signal input to the control part 160 and brightness of the lamp part 140 corresponding to the internal control signal.

When the transistor M is turned off at $t_3$, $I_L$ starts to decrease and becomes 0 A at $t_4$. The detection part 150 monitors a timing when $I_L$ becomes 0 A. The detection part 150 detects that $I_L$ is 0 A at $t_5$ due to a detection delay and provides the second control signal to the control part 160. That is, a time delay $t_{d21}$ occurs from the timing $t_4$ when $I_L$ becomes 0 A to the timing $t_5$ when the detection part detects that $I_L$ is 0 A.

When the second control signal is received, the control part 160 outputs a high level signal to $V_A$ at the timing $t_5$ to turn on the transistor M. When $V_A$ is changed to a high level signal, the gate voltage $V_B$ of the transistor M starts to increase. Since the transistor M is turned on when $V_B$ is equal to or higher than $V_{th}$, the transistor M is turned on at $t_6$ and $I_L$ increases from $t_6$. That is, a time delay $t_{d22}$ occurs from the timing $t_5$ when $V_A$ is changed to a high level signal to the timing $t_6$ when the transistor M is turned on. As a result, a time delay $T_{d21}+T_{d22}$ may occur from the timing $t_4$ when $I_L$ becomes 0 A to the timing $T_6$ when the transistor M is turned on. As described above, the control part 160 may drive the lamp part with predetermined brightness by controlling $I_L$ to be decreased or increased based on the first and second control signals received from the detection part 150. The correction part 170 may correct the external control signal to the internal control signal to correct the error in brightness due to the delay $T_{d11}+T_{d12}(=T_{d1})$ within the control part 160 and the error in brightness which occurs due to the duty ratio.

Figure 3:
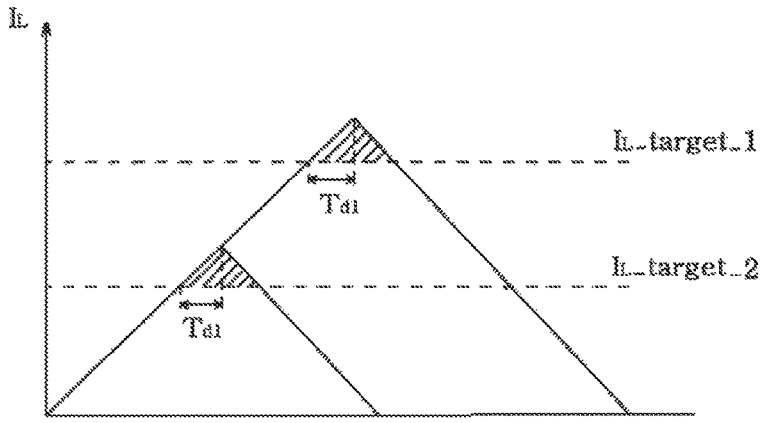
FIG. 3 is a graph illustrating an error in the brightness of a lamp part which occurs due to a delay within a control part of the lamp driving circuit.

FIG. 3 is a graph illustrating an error in the brightness of the lamp part 140 which occurs due to a delay within the control part 160. For example, when the external control signal of 0.6 V for driving the lamp part 140 with a brightness of 60% is applied to the control part 160, the control part 160 may set a target value of a current which will flow through the lamp part 140 to $I_L$_target_1. When the external control signal of 0.3 V for driving the lamp part 140 with a brightness of 30% is applied to the control part 160, the control part 160 may set a target value of a current which will flow through the lamp part 140 to $I_L$_target_2.

As described above with reference to FIG. 2, when the external control signal of 0.6 V (60% brightness) is directly applied to the control part 160 without passing through the correction part 170, $I_L$ exceeds $I_L$_target_1 due to the delay $T_{d1}$ ($T_{d11}+T_{d12}$ described above with reference to FIG. 2) within the control part 160. That may cause the lamp part 140 to be brighter than the originally intended 60% of brightness. In order to correct the error in brightness of the lamp part 140 as such, the correction part 170 may correct the external control signal of 0.6 V to output the internal control signal of 0.56 V, thereby driving the lamp part 140 to a brightness of 60%.

In a case in which the external control signal is 0.3 V (30% brightness), if the correction part 170 simply corrects the internal control signal to 0.28V, which is half of 0.56 V, the lamp part 140 becomes brighter than the target value of 30%. This happens because, when the external control signal is lowered, the error in brightness of the lamp part which occurs due to the delay $T_{d1}$ within the control part 160 exceeds in proportion than the target brightness. As can be seen from FIG. 3, in both cases where the external control signal is 0.6 V or 0.3 V, the delay $T_{d1}$ within the control part 160 is the same. Thus, an excess amount in the brightness of the lamp part 140 which occurs due to the delay $T_{d1}$ within the control part 160 may be the same. However, proportions of the excess amount of brightness against the target brightness are different. In this regard, the external control signal of 0.3 V may be further corrected than 0.28V which is half of 0.56 V, to thereby output the internal control signal of 0.23 V.

Figure 4:
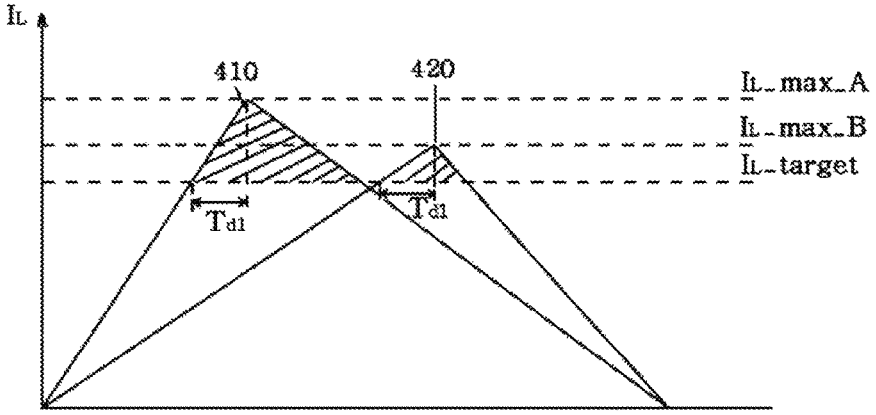
FIG. 4 is a graph illustrating an error in the brightness of the lamp part which occurs due to a change in duty ratio.

FIG. 4 is a graph illustrating an error in the brightness of the lamp part 140 which occurs due to a change in duty ratio. A duty ratio, i.e., a ratio of a voltage of the power source part 120 and a voltage across the lamp part 140 may be changed due to a change in voltage of the power source part 120, manufacturing variations of LEDs of the lamp part 140, a change in temperature, or the like. In FIG. 4, a case where the left $I_L$ graph 410 has a duty ratio lower than that of the right $I_L$ graph 420 is illustrated. For example, the left graph 410 may illustrate a case where a duty ratio is 30% and the right graph 420 may illustrate a case where a duty ratio is 70%.

When the duty ratio is low, the current $I_L$ of the lamp part 140 rapidly increases, compared with the case 420 where the duty ratio is high. Since the delay $T_{d1}$ within the control part 160 is the same in both cases, the error in brightness of the lamp part 140 is greater in the case 410 where the duty ratio is low than in the case 420 where the duty ratio is high. For example, when the external control signal of 0.5 V is applied to control the lamp part 140 to have a brightness of 50% and the control art 160 determines a target value of $I_L$ as $I_L$_target, an increase in the rate of $I_L$ is relatively high in the case 410 where the duty ratio is low and thus $I_L$ increases up to $I_L$_max_A for the delay time $T_{d1}$ within the control part 160. On the contrary, the increase in the rate of $I_L$ is relatively low in the case 420 where the duty ratio is high and thus increases only up to $I_L$_max_B for the delay time $T_{d1}$ within the control part 160. Due to this difference, although the same external control signal is applied, an error may occur in brightness of the lamp part 140 due to the change in duty ratio.

The correction part 170 may be configured to correct the error in brightness of the lamp part 140 which occurs due to the change in duty ratio described above. For example, when the external control signal of 0.5 V is received, the correction part 170 may receive duty information from the control part 160 and correct the external control signal depending on a duty ratio included in the duty information. For example, when the duty ratio is 30%, the correction part 170 may correct the external control signal of 0.5 V to the internal control signal of 0.42 V. When the duty ratio is 70%, the correction part 170 may correct the external control signal of 0.5 V to the internal control signal of 0.47 V. As a result, as described above with reference to FIGS. 1 to 4, since the correction part 170 is configured to correct an error in the brightness of the lamp part 140 which occurs due to a change in duty ratio and/or an error in the brightness of the lamp part 140 which occurs due to a delay within the control part 160, it is possible to more precisely control the brightness of the lamp part 140.

Figure 5:
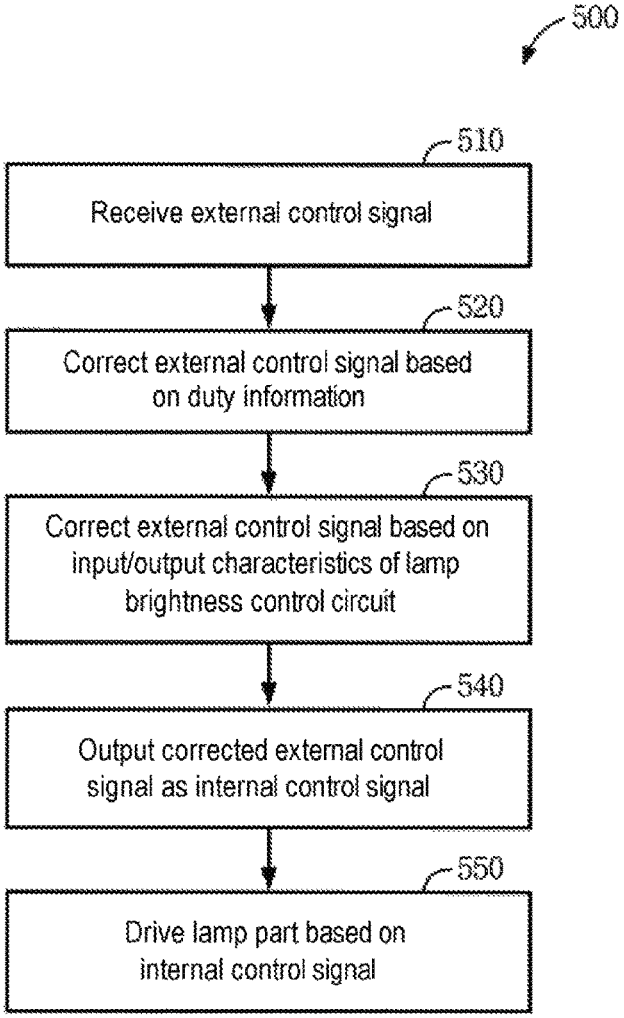
FIG. 5 illustrates a lamp driving method according to one embodiment of the present disclosure.

FIG. 5 illustrates a lamp driving method 500 according to one embodiment of the present disclosure. First, at step S510, the correction part may receive an external control signal for driving the lamp with predetermined brightness. At step S520, the correction part may receive duty information indicating a ratio (duty ratio) of a voltage of the power source part and a voltage across the lamp, and correct the external control signal based on the duty information. The correction part may correct an error in the brightness of the lamp which occurs due to a change in duty ratio by correcting the external control signal based on the duty information.

At step S530, the correction part may further correct the external control signal based on information indicative of input/output characteristics of the lamp brightness control circuit. In one embodiment, the information indicative of the input/output characteristics of the lamp brightness control circuit may include information indicative of the internal control signal input to the control part and brightness of the lamp part corresponding to the internal control signal. The correction part may further correct the external control signal based on the information indicative of the input/output characteristics of the lamp brightness control circuit to further correct an error in the brightness of the lamp part which occurs due to an internal delay of the control part. In one embodiment, the internal delay of the control part may be a delay from a timing when the control part detects that the current flowing through the lamp part has reached the target value to a timing when the current flowing through the lamp part starts to decrease. At step S540, the correction part may output the external control signal corrected at steps S520 and S530 as the internal control signal, and the output internal control signal may be provided to the control part. The control part may drive the lamp part with predetermined brightness based on the internal control signal received from the correction part at step S550. In FIG. 5, it is illustrated that both step S520 and step S530 are performed, but only one of the two steps may be performed and both steps may be performed together at one step.

Figure 6:
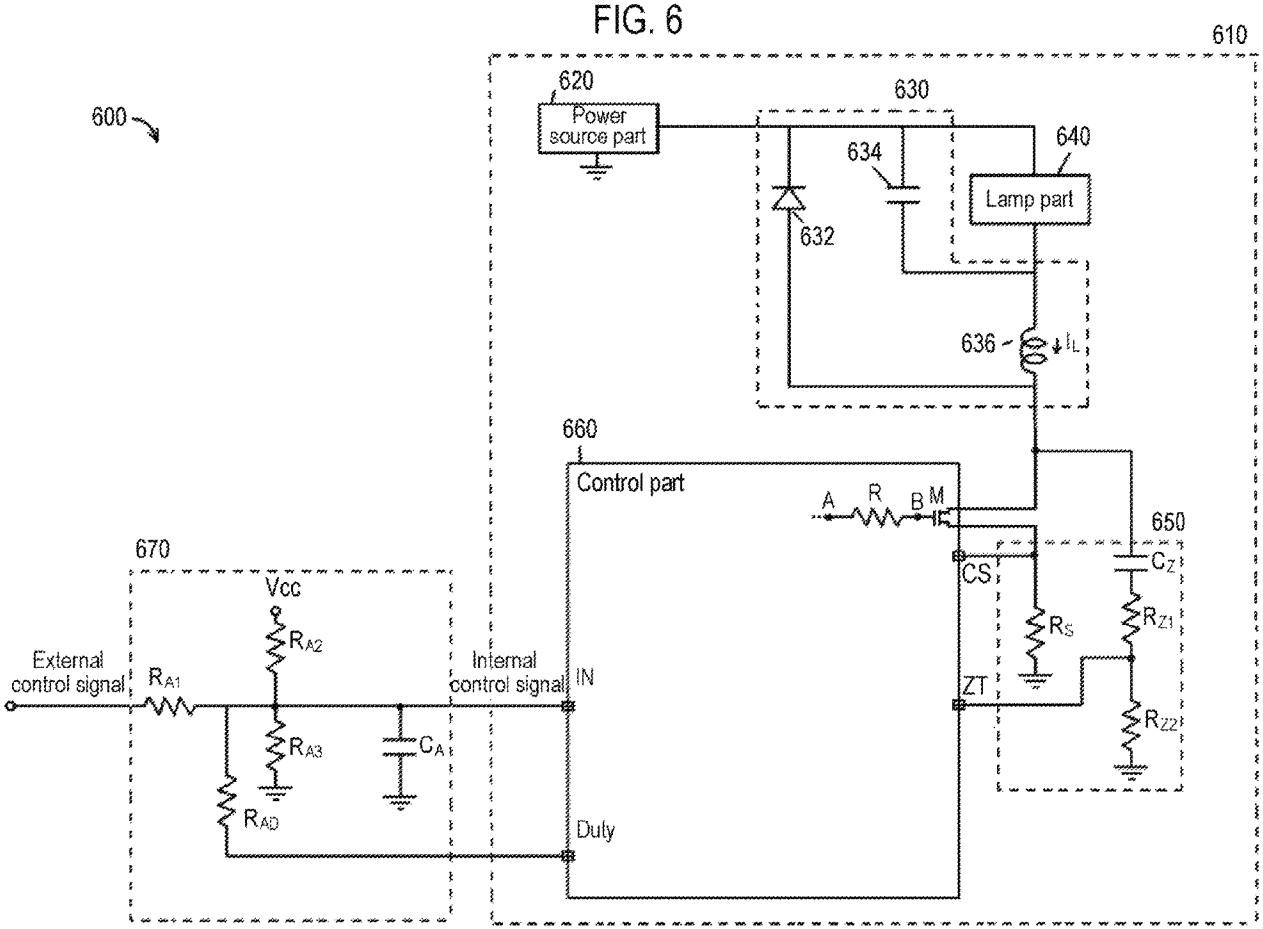
FIG. 6 is a circuit diagram of a lamp driving circuit according to one embodiment of the present disclosure.

FIG. 6 is a circuit diagram of a lamp driving circuit 600 according to one embodiment of the present disclosure. The lamp driving circuit 600 may include a lamp brightness control circuit 610 and a correction part 670. The lamp brightness control circuit 610 may include a power source part 620, an energy transmission part 630, a lamp part 640, a detection part 650, and a control part 660. The power source part 620 may be connected to the energy transmission part 630 to provide energy for driving the lamp part 640. In one embodiment, the power source part 620 may be a voltage source that can provide a supply voltage for operating the lamp part 640.

The correction part 670 may receive an external control signal for driving the lamp part 640 with predetermined brightness. In order to correct various lamp brightness errors which may occur in the lamp brightness control circuit 610, the correction part 670 may correct the external control signal to output an internal control signal.

The correction part 670 may be configured to correct the external control signal to the internal correction signal in order to correct an error in the brightness of the lamp part 640 which occurs due to a change in ratio (duty ratio) of a voltage (a supply voltage for operating the lamp part 640) of the power source part 620 and a voltage across the lamp part 640, and to correct an error in the brightness of the lamp part 640 which occurs due to detection/control delays within the control part 660. The correction part 670 may include first to third resistors $R_{A1}$, $R_{A2}$, and $R_{A3}$ for correcting the error in brightness of the lamp part 640 which occurs due to the internal delay of the control part 660, and a fourth resistor $R_{AD}$ and a capacitor $C_A$ for correcting the error in brightness of the lamp part 640 which occurs due to the change in duty ratio.

The external control signal may be applied to one end of the first resistor $R_{A1}$, and the other end of the first resistor $R_{A1}$ may be connected to one of the ends of the second to fourth resistors $R_{A2}$, $R_{A3}$, and $R_{AD}$. The other end of the second resistor $R_{A2}$ may be connected to a DC voltage source $V_{CC}$, and the other end of the third resistor $R_{A3}$ may be connected to a ground. The duty information from the control part 660 may be applied to the other end of the fourth resistor $R_{AD}$. In one embodiment, the control part 660 may provide the duty information in the form of a voltage to the correction part 670 via a duty terminal. One end of the capacitor $C_A$ may be connected to the other end of the first resistor $R_{A1}$ and one of the ends of the second to fourth resistors $R_{A2}$, $R_{A3}$, and $R_{AD}$. The other end of the capacitor $C_A$ may be connected to the ground. A voltage at a point where the other end of the first resistor $R_{A1}$ is connected to one of the ends of the second to fourth resistors $R_{A2}$, $R_{A3}$, and $R_{AD}$ and one end of the capacitor $C_A$ may be applied as the internal control signal to an IN terminal of the control part 660.

The values of the first to third resistors $R_{A1}$, $R_{A2}$, and $R_{A3}$ for correcting the error in brightness of the lamp part 640 which occurs due to the internal delay of the control part 660 and a value of the fourth resistor $R_{AD}$ for correcting the error in brightness of the lamp part 640 which occurs due to the change in duty ratio may be determined based on the information indicative of input/output characteristics corresponding to the duty ratio of the lamp brightness control circuit 610. The information indicative of input/output characteristics corresponding to the duty ratio of the lamp brightness control circuit 610 may be information indicative of the internal control signal input to the control part 660 at a specific duty ratio and brightness of the lamp part 640 corresponding to the internal control signal as an output. The correction part 670 may correct the external control signal based on the duty information received from the control part 660 to generate the internal control signal, to thereby provide the generated internal control signal to the IN terminal of the control part 660.

In one embodiment, the control part 660 may directly detect a voltage of the power source part 620 and a voltage across the lamp part 640 to provide duty information to the correction part 670. A duty ratio of a high level signal and a low level signal for controlling ON/OFF of a transistor M is substantially the same as the ratio of the voltage of the power source part 120 and the voltage across the lamp part 140. Thus, in another embodiment, the control part 660 may provide the ratio of the high level signal and the low level signal for controlling ON/OFF of the transistor M, as the duty information, to the correction part 670. In one embodiment, the duty information may be provided in the form of a voltage to the correction part 670.

The control part 660 may drive the lamp part 640 with predetermined brightness based on the internal control signal provided from the correction part 670. The lamp part 640 may include a plurality of LEDs, and may be driven by energy transmitted from the power source part 620 through the energy transmission part 630. In one embodiment, the energy transmission part 630 may include a diode 632, a capacitor 634, and an inductor 636. In this case, the power source part 620 may be connected to one end of the diode 632, and the detection part 650 and the control part 660 may be connected to the other end of the diode 632. The capacitor 634 and the inductor 636 connected in series may be connected in parallel to the diode 632, and the lamp part 640 may be connected in parallel to the capacitor 634.

The control part 660 may control the energy transmitted from the power source part 620 to the lamp part 640 through the energy transmission part 630 based on the internal control signal. The brightness of the lamp part 640 is determined by an average value of a current flowing through the lamp part 640. The control part 660 may drive the lamp part 640 with predetermined brightness by controlling the current flowing through lamp part 640 to be increased and decreased. Specifically, the control part 660 may set a target value of the current flowing through the lamp part 640 based on the internal control signal. When the current flowing through the lamp part 640 reaches the target value, the control part 660 may control the current flowing through the lamp part 640 to be decreased. Further, when the current flowing through the lamp part 640 becomes 0 A, the control part 660 may control the current flowing through the lamp part 640 to be increased.

The detection part 650 monitors a current $I_L$ flowing through the inductor 636, and the current $I_L$ is substantially the same as the current flowing through the lamp part 640. The detection part 650 may include a capacitor $C_Z$ and two resistors $R_{Z1}$ and $R_{Z2}$, connected in series and connected to the inductor 636 and a drain of the transistor M within the control part 660, and a resistor $R_S$ connected to a source of the transistor M. The control part 660 may monitor a voltage across the resistor $R_S$ to detect that the current flowing through the lamp part 640 reaches the target value, and monitor a voltage across the resistor $R_{Z2}$ to detect that the current flowing through the lamp part 640 becomes 0 A. In FIG. 6, it is illustrated that the transistor M is within the control part 660, but the transistor M may also be positioned outside the control part 660.

In one embodiment, the control part 660 may operate in a quasi-resonant (QR) mode. Specifically, the control part 660 monitors a voltage across the resistor $R_S$ within the detection part 650. When it is detected that the current flowing through the lamp part 640 has reached the target value, the control part 660 may turn off the transistor M to decrease the current flowing through the lamp part 640. Further, the control part 660 monitors a voltage across the resistor $R_{Z2}$ within the detection part 650. When it is detected that the current flowing through the lamp part 640 becomes 0 A, the control part 660 may turn on the transistor M to increase the current flowing through the lamp part 640. A predetermined delay may occur from a timing when the control part 660 detects that the current flowing through the lamp part 640 has reached the target value to a timing when the transistor M is turned off, and this delay may cause an error in the brightness of the lamp part 640. The correction part 670 may correct the external control signal to the internal control signal to correct the error in brightness of the lamp part 640 which occurs due to detection/control delays within the lamp brightness control circuit 610 described above and the error in brightness of the lamp part 640 which occurs due to the change in duty ratio. When the correction part 670 corrects the external control signal based on the duty information received from the control part 660 and outputs the internal control signal to the control part 660, the control part 660 may drive the lamp part 640 with predetermined brightness depending on the internal control signal.

Figure 7:
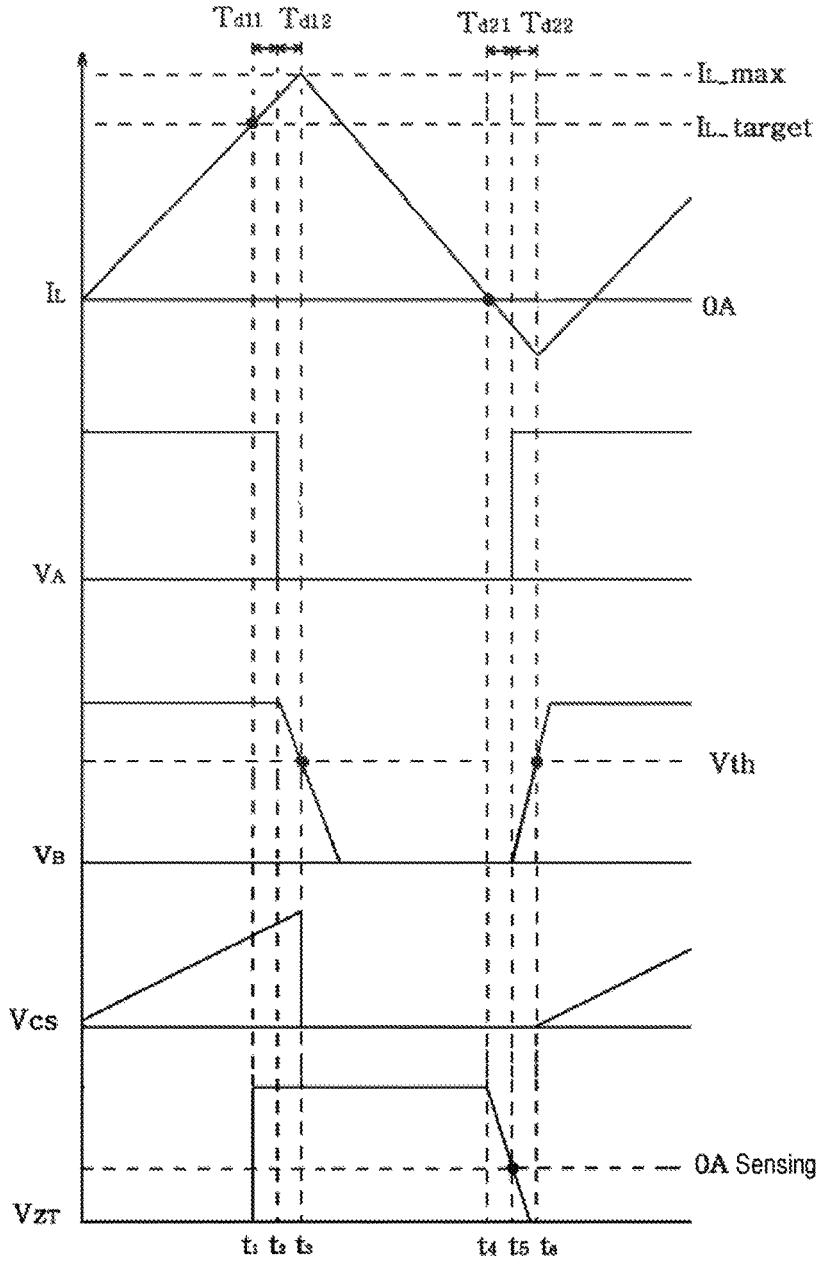
FIG. 7 is a graph illustrating operational waveforms of the lamp driving circuit.

FIG. 7 is a graph illustrating operational waveforms of the lamp driving circuit 600. $I_L$ denotes a current flowing through the inductor 636 of the energy transmission part 630 (which is substantially the same as the current flowing through the lamp part 640), and the brightness of the lamp part 640 is determined by an area of $I_L$ on the graph. $V_A$ denotes an internal signal output by the control part 660 to control the transistor M. $V_A$ may include a high level signal for turning on the transistor M and a low level signal for turning off the transistor M. As described above, since the ratio of the high level signal and the low level signal of $V_A$ is substantially the same as the ratio of the voltage of the power source part and the voltage across the lamp part, the control part 660 may provide the ratio of the high level signal and the low level signal of $V_A$, as the duty information, to the correction part 670.

As can be seen from FIG. 6, $V_A$ is applied to the gate of the transistor M through the resistor R. $V_B$ denotes a gate voltage of the transistor M. When $V_B$ is equal to or higher than a threshold value $V_{th}$, the transistor M is turned on to increase $I_L$. When $V_B$ is lower than the threshold $V_{th}$, the transistor M is turned off to decrease $I_L$.

$V_{CS}$ denotes a voltage across the resistor $R_S$ within the detection part 650. When $V_{CS}$ reaches a predetermined value, the control part 660 may detect that the current flowing through the lamp part 640 has reached the target value. $V_{ZT}$ denotes a voltage across the resistors $R_{Z2}$ within the detection part 650. When $V_{ZT}$ reaches a predetermined value, the control part 660 may detect that the current flowing through the lamp part 640 has become 0 A.

As described above, the correction part 670 may correct the external control signal to the internal control signal to correct various lamp brightness errors which occurs in the control part 660. The control part 660 may set a target value $I_{L_}$target of $I_L$ based on the internal control signal. When $I_L$ reaches $I_{L_}$target, the control part 660 turns off the transistor M to decrease $I_L$. When $I_L$ becomes 0 A, the control part 660 may turn on the transistor M to increase $I_L$. In FIG. 7, since the transistor M is turned on until $t_1$, $I_L$ increases. When the control part 660 detects that $V_{CS}$ has a predetermined value at $t_1$, the control part 660 may determine that $I_L$ has reached the target value $I_{L_}$target. The control part 660 determines that $I_L$ has reached the target value $I_{L_}$target at $t_1$, but $V_A$ may be changed to a low level signal at $t_2$ due to an internal delay to turn off the transistor M. That is, a time delay $T_{d11}$ may occur from the timing $t_1$ when the control part 660 determines that $I_L$ has reached the target value $I_{L_}$target to the timing $t_2$ when $V_A$ is changed to a low level signal.

When $V_A$ is changed to a low level signal, the gate voltage $V_B$ of the transistor M starts to decrease. In order for the transistor M to be turned off, since $V_B$ should decrease to $V_{th}$, a time delay may occur even when $V_A$ is changed to a low level signal and the transistor M is turned off. As can be seen from FIG. 7, $V_A$ is changed to a low level signal at $t_2$, but $V_B$ is lower than $V_{th}$ at $t_3$ and thus the transistor is turned off. That is, a time delay $T_{d12}$ may occur from the timing $t_2$ when $V_A$ is changed to a low level signal to the timing $t_3$ when the transistor M is turned off within the control part 660. As a result, a time delay $T_{d11}+T_{d12}(=T_{d1})$ occurs from the timing $t_1$ when $I_L$ has reached $I_{L_}$target to the timing $t_3$ when the transistor M is turned off and $I_L$ starts to decrease and thus $I_L$ exceeds $I_{L_}$target and increases up to $I_{L_}$max. Thus, the correction part 670 may correct the external control signal in consideration of an error that the brightness of the lamp part 640 is higher than the target value due to a state in which $I_L$ exceeds $I_L$_target and increases up to $I_L$_max.

As described above with reference to FIG. 6, the correction part 670 may be configured to correct the external control signal to the internal control signal to correct the error in brightness of the lamp part 640 which occurs due to various delays within the control part 660. The delay within the control part 660 may be the time delay $T_{d11}+T_{d12}(=T_{d1})$ from the timing $t_1$ when $I_L$ has reached $I_L$_target to the timing $t_3$ when the transistor M is turned off and $I_L$ starts to decrease.

When the transistor M is turned off at $t_3$, $I_L$ starts to decrease and becomes 0 A at $t_4$. When the control part 660 detects that $V_{ZT}$ has a predetermined value at $t_5$, the control part 660 determines that the current flowing through the lamp part 640 is 0 A, which may result from a detection delay. That is, a delay $t_{d21}$ occurs from the timing $t_4$ when $I_L$ is 0 A to the timing $t_5$ when the control part 660 determines that $I_L$ is 0 A. When the control part 660 determines that $I_L$ is 0 A, a high level signal is output from $V_A$ at $t_5$ to turn on the transistor M.

When $V_A$ is changed to a high level signal, the gate voltage $V_B$ of the transistor M starts to increase. Since the transistor M is not turned on until $V_B$ is higher than $V_{th}$, the transistor M is turned on at $t_6$ and $I_L$ starts to increase from $t_6$. That is, a delay $t_{d22}$ occurs from the timing $t_5$ when $V_A$ is changed to a high level signal to the timing $t_6$ when the transistor M is turned on. As a result, a delay $T_{d21}+T_{d22}$ may occur from the timing $t_4$ when $I_L$ becomes 0 A to the timing $t_6$ when the transistor M is turned on. As described above, the control part 660 may drive the lamp part with predetermined brightness by controlling $I_L$ to be decreased or increased. The correction part 670 may correct the external control signal to output the internal control signal to correct the error in brightness due to the delay $T_{d11}+T_{d12}(=T_{d1})$ within the control part 160 and the error in brightness which occurs due to the duty ratio.

FIGS. 8A and 8B are diagrams illustrating results of testing a control error in the brightness of the lamp part 640 of the lamp driving circuit 600 using the circuit diagram of FIG. 6. FIG. 8A illustrates a test result obtained by directly inputting the external control signal to the control part 660 without using the correction part 670. FIG. 8B illustrates a test result obtained by providing the internal control signal to the control part 660 after the correction part 670 corrects the external control signal.

The values of the first to third resistors $R_{A1}$, $R_{A2}$ and $R_{A3}$ for correcting the error in brightness of the lamp part 640 which occurs due to the internal delay of the control part 660 and the value of the fourth resistor $R_{AD}$ for correcting the error in brightness of the lamp part 640 which occurs due to the change in duty ratio may be determined based on the internal control signal input to the control part 660 at a specific duty ratio and the information indicative of the brightness of the lamp part 640 corresponding to the internal control signal as an output. The tests of FIGS. 8A and 8B were conducted under the following conditions.

Power source part 620=180~220 V

Inductor 636=220 uH, Capacitor 634=680 nF $R_{A1}$=82 KΩ,$R_{A2}$=263 KΩ,$R_{A3}$=27 KΩ,$R_{AD}$=160 KΩ,$C_A$=1 nF,$V_{CC}$=9 V $R$=100Ω,$R_S$=0.5Ω,$R_{z1}$=300 KΩ,$R_{z2}$=3 KΩ,$C_{zt}$=33 pF $V_{Duty}$=2 V@50% (when duty ratio is 50%, $V_{Duty}$=2 V output)

As can be seen from FIG. 8A, the external control signals 1.5 V, 1.05 V, and 0.675 V are external signals indicating that the lamp part 640 is driven with brightness of 100%, 70%, and 45%, respectively. The peak values ($I_L$_Max) of the current $I_L$ required for driving the lamp part 640 with a brightness of 100%, 70%, and 45% are 2,000 mA, 1,400 mA, and 900 mA, respectively. When the external control signals 1.5 V, 1.05 V, and 0.675 V are directly input to the control part 660 in a state in which the duty ratio is 50%, the actual peak values ($I_L$_Max) of the current $I_L$ of the lamp part 640 are 1,953 mA, 1,311 mA, and 816 mA. That causes errors of −2.53%, −6.38%, and −9.31%, respectively, compared with the required peak values 2,000 mA, 1,400 mA, and 900 mA.

When the external control signals 1.5 V, 1.05 V, and 0.675 V are directly input to the control part 660 in a state in which the duty ratio is 23%, the actual peak values ($I_L$_Max) of the current $I_L$ of the lamp part 640 are 2,047 mA, 1,395 mA, and 886 mA. That causes errors of 2.35%, −0.38%, and −1.51%, respectively, compared with the required peak values 2,000 mA, 1,400 mA, and 900 mA. Based on the results of FIG. 8A, when the external control signal is directly input to the control part 660 without passing through the correction part 670, the brightness of the lamp part 640 has an error of −9.31 to 2.53% due to various detection/control delays.

FIG. 83 illustrates a test result when e correction part 670 corrects the external control signal and provides the internal control signal to the control part 660. As can be seen in FIG. 8B, various lamp brightness errors which occur in the lamp brightness control circuit 610 are corrected. Specifically, unlike the case of FIG. 8A, in FIG. 8B, the error in brightness of the lamp part 640 is significantly reduced to −1.96 to 0.92% by correcting the external control signal to the internal control signal. The error in brightness of the lamp part 640 is not perfectly corrected in spite of the use of the correction part 670. It is because resistor elements having accurately required values are not used as the resistor elements $R_{A1}$, $R_{A2}$, $R_{A3}$, and $R_{AD}$ of the correction part 670, but resistor elements having most similar values among generally manufactured resistor elements may be used and the resistor elements actually have manufacturing variations.

According to the present disclosure in some embodiments, it is possible to provide an LED driving circuit capable of correcting an error in brightness of an LED due to various delays within a control circuit and an error in the brightness of an LED due to a change in duty ratio.

While certain embodiments have been described, these embodiments have been presented by way of example only, and are not intended to limit the scope of the disclosures. Indeed, the embodiments described herein may be embodied in a variety of other forms. Furthermore, various omissions, substitutions and changes in the form of the embodiments described herein may be made without departing from the spirit of the disclosures. The accompanying claims and their equivalents are intended to cover such forms or modifications as would fall within the scope and spirit of the disclosures.

What is claimed is:

1. A lamp driving circuit for driving a lamp part, comprising:

a signal correction circuit configured to receive a first control signal for driving the lamp part with a predetermined brightness, to receive duty information indicative of a ratio of a supply voltage for operating the lamp part and a voltage across the lamp part, and to correct the first control signal based on the duty information to generate a second control signal; and a controller configured to receive the second control signal from the signal correction circuit, and to drive the lamp part with the predetermined brightness based on the second control signal, wherein the signal correction circuit is configured to further correct the first control signal based on the second control signal which is input to the controller, and information indicative of brightness of the lamp part corresponding to the second control signal to generate the second control signal, wherein the signal correction circuit is configured to further correct the first control signal such that a first error in brightness of the lamp part, which occurs due to an internal delay of the controller, is corrected, wherein the signal correction circuit includes:

first to third resistors configured to correct the first error in brightness of the lamp part which occurs due to the internal delay of the controller; and a fourth resistor configured to correct a second error in brightness of the lamp part which occurs due to a change in the ratio of the supply voltage for operating the lamp part and the voltage across the lamp part, wherein the first control signal is applied to one end of the first resistor, wherein the other end of the first resistor is connected to one of the ends of the second to fourth resistors, wherein the other end of the second resistor is connected to a DC voltage source, wherein the other end of the third resistor is connected to a ground, and wherein the duty information is applied to the other end of the fourth resistor.

2. The circuit of claim 1, wherein the signal correction circuit is configured to correct the first control signal based on the duty information such that the second error in brightness of the lamp part, which occurs due to the change in the ratio of the supply voltage for operating the lamp part and the voltage across the lamp part, is corrected.

3. The circuit of claim 1, wherein the internal delay of the controller is a delay from a timing when the controller detects that a current flowing through the lamp part has reached a target value to a timing when the current flowing through the lamp part starts to decrease.

4. The circuit of claim 1, further comprising a signal detection circuit configured to detect a current flowing through the lamp part, wherein the signal detection circuit is configured to provide a first detection signal to the controller when the current flowing through the lamp part has a first value, and to provide a second detection signal to the controller when the current flowing through the lamp part has a second value greater than the first value, and the first value is determined based on the second control signal.

5. The circuit of claim 4, wherein the controller is further configured to decrease the current flowing through the lamp part upon receiving the first detection signal from the signal detection circuit.

6. The circuit of claim 5, wherein the internal delay of the controller is a delay from a timing when the controller receives the first detection signal to a timing when the current flowing through the lamp part starts to decrease.

7. The circuit of claim 4, wherein the controller is further configured to increase the current flowing through the lamp part upon receiving the second detection signal from the signal detection circuit.

* * * * *